US010822550B2

(12) United States Patent
Fleury et al.

(10) Patent No.: US 10,822,550 B2
(45) Date of Patent: Nov. 3, 2020

(54) METHOD OF PROCESSING AND/OR RECOVERING AND/OR REUTILIZING RESIDUES, ESPECIALLY FROM REFINERY PROCESSES

(71) Applicant: List Technology AG, Arisdorf (CH)

(72) Inventors: Pierre-Alain Fleury, Ramlinsburg (CH); Pierre Liechti, Muttenz (CH); George Schlager, Firsfelden (CH)

(73) Assignee: List Technology AG, Arisdorf (CH)

( * ) Notice: Subject to any disclaimer, the term of this patent is extended or adjusted under 35 U.S.C. 154(b) by 283 days.

(21) Appl. No.: 15/527,108

(22) PCT Filed: Nov. 12, 2015

(86) PCT No.: PCT/EP2015/076377
§ 371 (c)(1),
(2) Date: May 16, 2017

(87) PCT Pub. No.: WO2016/078994
PCT Pub. Date: May 26, 2016

(65) Prior Publication Data

US 2019/0093022 A1 Mar. 28, 2019

(30) Foreign Application Priority Data

Nov. 17, 2014 (DE) ..... 10 2014 116 757
Apr. 27, 2015 (DE) ..... 10 2015 106 439

(51) Int. Cl.
*C10G 31/06* (2006.01)
*C10B 47/44* (2006.01)

(52) U.S. Cl.
CPC ..... *C10G 31/06* (2013.01); *C10B 47/44* (2013.01); *C10G 2300/1003* (2013.01); *C10G 2300/107* (2013.01); *C10G 2300/1077* (2013.01)

(58) Field of Classification Search
CPC ..... C10G 31/06; C10B 47/44
See application file for complete search history.

(56) References Cited

U.S. PATENT DOCUMENTS 2,494,510 A * 1/1950 Hughes ..... C07C 2/18 585/528
3,687,422 A 8/1972 List
(Continued)

FOREIGN PATENT DOCUMENTS

AT 334328 B 1/1976
CH 506322 A 4/1971
(Continued)

OTHER PUBLICATIONS

Fleury, Pierre-Alain, "Bulk Polymerisation or Copolynnerisation in a Novel Continuous Kneader Reactor", Macromolecular Symposia, vol. 243, pp. 287-298, 2006.*
(Continued)

*Primary Examiner* — Renee Robinson
(74) *Attorney, Agent, or Firm* — Bachman & LaPointe, PC

(57) ABSTRACT

In a method of processing and/or recovering and/or reutilizing residues, especially from refinery processes, containing a base substance, especially comprising hydrocarbon, for example kerosene, and oil, and also metallic residues, the residues are to be introduced into a first reactor (5) in which a portion of the volatile residues evaporates and then is transferred into a second reactor (10) and solidifies therein by cooling, optionally promoted by evaporation of water.

17 Claims, 1 Drawing Sheet

(56) References Cited

U.S. PATENT DOCUMENTS

| | | | | |
|---|---|---|---|---|
| 3,880,407 | A | 4/1975 | List | |
| 4,545,892 | A * | 10/1985 | Cymbalisty | B01D 11/0257 208/391 |
| 5,147,135 | A | 9/1992 | List et al. | |
| 5,407,266 | A | 4/1995 | Doetsch et al. | |
| 5,653,865 | A * | 8/1997 | Miyasaki | B08B 9/0933 208/13 |
| 2003/0228196 | A1* | 12/2003 | Satchwell | B09B 3/00 405/128.5 |
| 2009/0149571 | A1* | 6/2009 | Lux | C02F 11/10 523/129 |
| 2011/0294978 | A1* | 12/2011 | Diener | B01D 1/14 528/503 |
| 2015/0273731 | A1 | 10/2015 | Fleury et al. | |

FOREIGN PATENT DOCUMENTS

| | | | |
|---|---|---|---|
| CH | 658798 | A5 | 12/1986 |
| CH | 686406 | A5 | 3/1996 |
| DE | 19940521 | A1 | 4/2001 |
| DE | 102013100182 | A1 | 6/2014 |
| EP | 0517068 | A1 | 12/1992 |
| EP | 1127609 | A2 | 8/2001 |
| JP | H09109144 | A | 4/1997 |

OTHER PUBLICATIONS

European examination report for patent application No. 15 804 691.2-1101 dated Aug. 29, 2018.
Chinese office action for patent application No. 201580073582.9 filed Oct. 31, 2018.

* cited by examiner

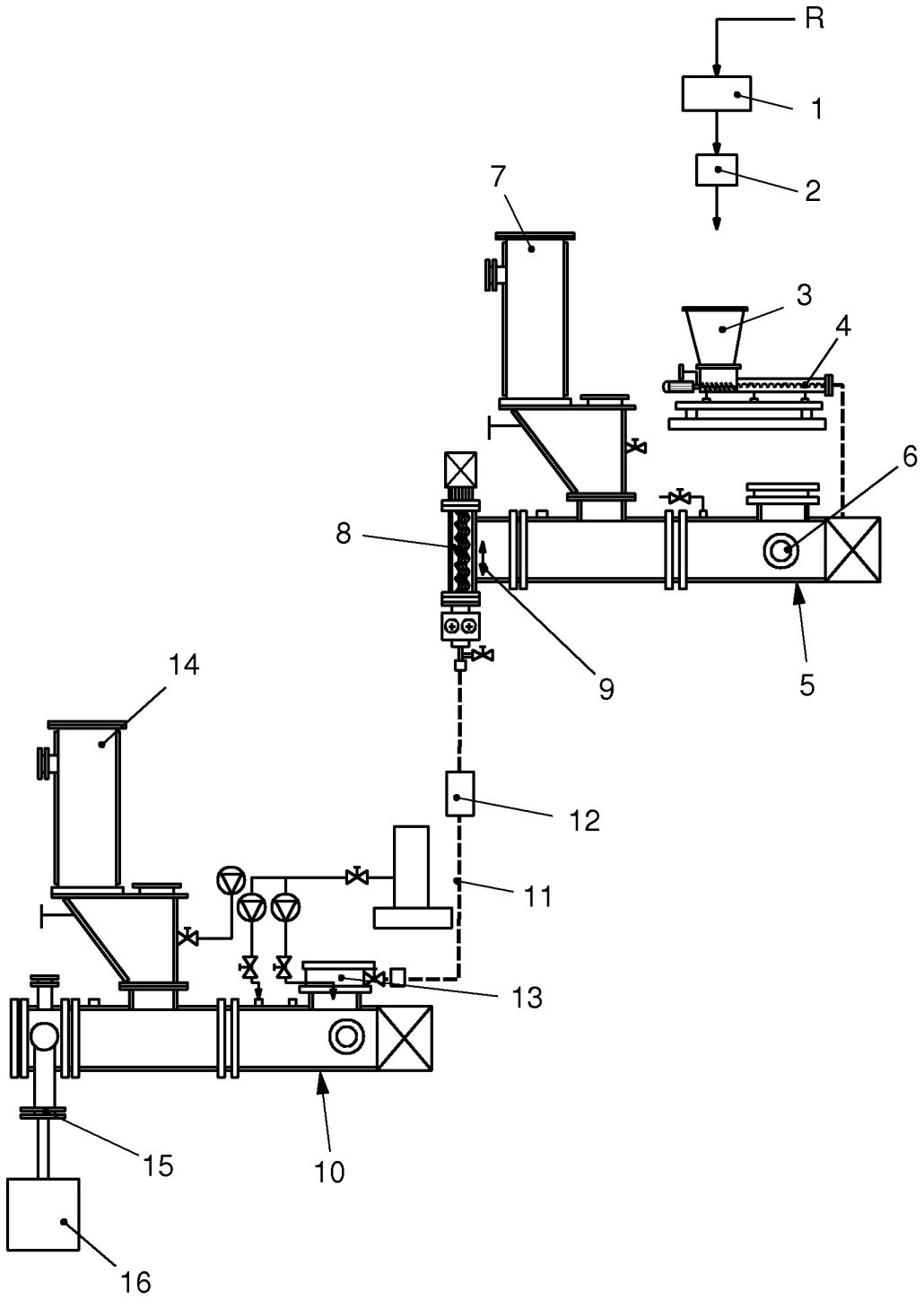
R
1
2
7
3
4
6
8
9
5
14
12
11
13
15
10
16

METHOD OF PROCESSING AND/OR RECOVERING AND/OR REUTILIZING RESIDUES, ESPECIALLY FROM REFINERY PROCESSES

BACKGROUND OF THE INVENTION

The present invention relates to a method of processing and/or recovering and/or reutilizing residues, especially from refinery processes, comprising a base substance, especially with hydrocarbon, for example kerosene, and oil, and also metallic residues.

There are a multitude of industrial processes and process steps which give rise to residues consisting, for example, of hydrocarbons, oil and metals. All three constituents are too valuable to be simply disposed of.

The most significant sources for residues with hydrocarbons are, for example, crude oil refining processes. These include atmospheric distillation, distillation under reduced pressure, production of heating oil and fuels, alkylation with sulfuric acid, polymerization of a mixture of propene and butane with phosphoric acid, high-temperature isomerization, production of lubricant oils, rectification, pipe still distillation, evaporative distillation, coking, catalytic cracking, reforming, refinery hydrogenation, hydrodesulfurization of crude oil, oil bleaching by hydration, deasphaltation with solvent, indirect desulfurization of distillation residues, etc.

Every crude oil, every refining method and every technological treatment leaves residues or refinery wastes. These wastes are known by various names: "gudron", "gudron clay", oily sediment, filtercake, sludge, gravitational residue, centrifuge residue, deoxidant residue after the cleaning process, acid residue, acidic oil waste, refinery sludge, pitch, bitumen, greasy sediment, tar, "gatch", oily water, etc.

The volumes of the wastes originating from refinery treatments are relatively large compared to processed crude oil and make up a significant proportion of industrial wastes. It is very often the case that these newly processed residues are generally converted to coke or incinerated.

The gasoline fraction makes up the most significant proportion of the mineral oil products and is classified by the respective end use: specialty fuels, motor gasoline, aviation gasoline, jet fuel, heavy gasoline, kerosene, lamp oil, diesel fuel, heating oil, oils (motor oil, aviation oil, turbine oil, insulation oil, hydraulic oil, metalworking oil, medical oil, etc.), lubricating and protective greases, bitumen, mineral oil wax as heavy fraction crystallizate, petroleum coke (thermal cracking of distillation residues and secondary process residues).

Mention should further be made, merely by way of example, of coolants or lubricants for machine tools that find use in production processes. A great amount of residues occurs here, including hydrocarbons, oils and metallic residues. JP 09-109144, for example, describes a method of fractionating a metalworking suspension, in which kerosene is first added to the metalworking suspension as an extractant for lowering the viscosity, in order to separate the cutting grains from the cooling lubricant in a wet classifying method. This publication concerns the clean separation of the cutting grains from the cooling lubricant, and not the recovery of the cooling lubricant in high-quality form as required, for example, for reuse in sawing.

SUMMARY OF THE INVENTION

It is an object of the present invention to provide a method of the aforementioned type, by which refinery residues comprising kerosene, oil, asphaltenes and metals in particular can be processed in an effective and economic manner.

The object is achieved by introducing the residues into a first reactor in which the solvent is and/or the volatile constituents are evaporated.

In this case, the product is discharged from the reactor generally as a melt.

More preferably, however, the product is transferred into a second reactor and solidified and/or granulated therein by cooling and optionally evaporative cooling.

The reactors used are preferably mixing kneaders. A distinction is drawn here essentially between single-shaft and twin-shaft mixing kneaders. A single-shaft mixing kneader is known, for example, from AT 334 328, CH 658 798 A5 or CH 686 406 A5. In this case, an axial shaft provided with disk elements which rotates about an axis of rotation in a direction of rotation is arranged in a housing. This brings about the transport of the product in transport direction. Counterelements are fixed to the housing between the disk elements. The disk elements are arranged in planes at right angles to the kneader shaft and form clear sectors between them, which form kneading spaces with the planes of adjacent disk elements.

A multishaft mixing and kneading machine is described in CH-A 506 322. In that case, radial disk elements are present on a shaft, and axially aligned kneading bars are arranged between the disks. These disks intermesh with mixing and kneading elements in the form of a frame from the other shaft. These mixing and kneading elements clean the disks and kneading bars of the first shaft. The kneading bars on the two shafts in turn clean the inner wall of the housing.

These known twin-shaft mixing kneaders have the disadvantage of having a weak point because of the Figure-of-Eight-Shaped housing cross section in the region of the connection of the two shaft housings. High stresses occur in this region in the processing of viscous products and/or in processes that run under pressure, and these can be controlled only by complex construction measures.

A mixing kneader of the abovementioned type is known, for example, from EP 0 517 068 B1. In this case, two axially parallel shafts rotate either in opposite senses or the same sense in a mixer housing. As they do so, mixing bars attached to disk elements interact. As well as the function of mixing, the mixing bars have the task of cleaning surfaces of the mixer housing, of the shafts and of the disk elements that come into contact with product very efficiently, and hence of preventing unmixed zones. Especially in the case of highly compacting, hardening and encrusting products, the close clearance of the mixing bars leads to high local mechanical stresses on the mixing bars and the shafts. These peak forces occur especially when the mixing bars encroach into those zones where the product cannot escape easily. Such zones exist, for example, where the disk elements are attached to the shaft.

Moreover, DE 199 40 521 A1 discloses a mixing kneader of the abovementioned type, in which the bearing elements in the region of the kneading bars form a recess, in order that the kneading bars have a maximum axial reach. Such a mixing kneader has excellent self-cleaning of all surfaces of the housing and of the shafts that come into contact with product, but has the property that the bearing elements of the kneading bars, because of the paths of the kneading bars, necessitate recesses that lead to complicated bearing element shapes. This results firstly in a complex production method and secondly in local peak stresses on the shaft and the bearing elements under mechanical stress. These peak stresses, which occur mainly in the sharp-edged recesses, and changes in thickness, especially in the region where the bearing elements are welded onto the shaft core, are triggers for cracks in the shaft and the bearing elements owing to material fatigue.

A mixing kneader differs fundamentally from an extruder. Whereas, in an extruder, a screw rotates in a corresponding tubular housing shell and the product to be treated is thus conveyed from an inlet to an outlet in the screw flights, a product space and a gas space are formed in a mixing kneader. As its name suggests, the product space is filled with product, the gas space, which is usually above the product space, is filled with gas in the course of treatment of the product, and the gas is then drawn off by means of appropriate vapors. It is only in the product space that actual treatment of the product, namely mixing and kneading and also transporting, takes place; the gas space is product-free.

As an alternative to a mixing kneader with counterhooks, in the first process stage (evaporation of the solvent), it is possibly also possible to use a mixing kneader without counterhooks, a thin-film evaporator or a paddle drier. For the second stage (cooling/granulation), as well as the mixing kneader, a chill roll, a chill belt or a solution with water tanks or a conveying unit under water are conceivable. The various combinations of the various options for the two process stages shall also be encompassed by the concept of the invention.

The present method of the invention uses, by way of example, the above-described two-stage method with two mixing kneaders, wherein the residues to be processed pass through these mixing kneaders successively. According to the refinery, the methods presented here are preceded by other process steps, for example washing or premixing of the residues with solvent. According to the upstream methods, a different mixture of solid residues, residual oils and solvents and/or volatile constituents is established. In experiments, it was found that, in the first method step, the evaporation of the solvent and/or the readily volatile constituents, the coefficient of heat transfer is significantly higher the more residual oil is present. This leads to an acceleration and overall improvement in the method.

The introduction of the homogenized residues into the first mixing kneader is preferably effected by means of a pump, specifically by means of an eccentric screw pump as known under the trade name Moyno Pump. In experiments, for example, another pump, namely the gear pump, has been found to be extremely unfavorable, since it has a tendency to become blocked when the feed (residue feed) is too irregular.

In addition, the inlet into the first mixing kneader should also be cooled, since it otherwise has a tendency to become blocked when the feed is interrupted. This is particularly true when the residues are not flashed in, i.e. introduced into the mixing kneader under pressure.

Furthermore, it has been found to be desirable for the fill level in the mixing kneader(s) to be regulated by an adjustable weir. This results in a more suitable means of control of the overall method.

The residues can be treated in the first mixing kneader either under atmospheric or reduced pressure. The treatment of the product in the mixing kneader takes place with addition of heat and also under friction. If solvents and/or readily volatile constituents that ignite readily, for example kerosene, are being treated, penetration of oxygen into the mixing kneader should be prevented.

The transfer of the product from the first mixing kneader into the second mixing kneader is preferably effected by a flexible conduit which is heatable, but can optionally also be cooled.

By contrast with the first mixing kneader, it should be possible to heat the inlet of the second mixing kneader. For this purpose, a suitable collar is envisaged.

In the second mixing kneader, cooling results in conversion of the pasty residues coming from the first mixing kneader to the solid phase place, such that solids are obtained at the outlet. However, these also include a relatively large amount of dust, such that at least one sluice vessel should be connected downstream of the second mixing kneader. To improve the cooling, water can optionally also be introduced into the second mixing kneader, which evaporates and hence promotes the cooling (evaporative cooling).

Protection is likewise sought for a corresponding plant for processing of above-describe residues, in which a first mixing kneader is followed downstream by a second mixing kneader, the two mixing kneaders being connected to one another by a heatable conduit. Further device-based features are described above.

BRIEF DESCRIPTION OF FIGURES

Further features, advantages and details of the invention will be apparent from the description which follows and from the drawing; the drawing shows, in its sole FIGURE, a schematic diagram of a plant for processing and/or recovery and/or reutilization of residues, especially from refinery processes, especially for processing of a residue composed of kerosene, oil and metal constituents.

DETAILED DESCRIPTION

In two separate experiments, the residues contained different levels of residual oil. It was found here that the residues with the smaller oil constituent are significantly less easily processible than the residues having the greater oil constituents. This was particularly because the residues with the smaller oil constituents had a significantly worse coefficient of heat transfer than the residues with the greater oil constituents.

This residue R is preferably subjected to one or more pretreatments 1, for example a washing or homogenization method. In a further corresponding pretreatment 2, extraneous constituents can be very substantially eliminated.

The pretreated residues are now transferred into a receiving funnel 3, before being transferred by means of a pump 4 into a first mixing kneader 5. The pump 4 is preferably a Moyno pump, which is understood to mean a progressive cavity screw pump. Experiments with a gear pump failed.

The transfer into the first mixing kneader is via an inlet 6 which is preferably cooled. This should be done particularly when no additional flash nozzle is being utilized, with which the residues are introduced into the first mixing kneader under pressure. Without cooling of the inlets, there is the risk of blockages, especially on interruption of the feed.

In the first mixing kneader, the residues are concentrated, with removal of the corresponding vapors via a vapor dome 7. In this first mixing kneader, the concentration results in a transition from the liquid phase to a pasty or viscous phase of the residues.

According to the invention, a height-adjustable weir 9 is provided upstream of an outlet 8 in the first mixing kneader.

This weir 9 should also be heated and serves to control a fill level in the first mixing kneader.

The transfer of the pasty residue from the first mixing kneader to a second mixing kneader 10 is effected through a conduit 11, indicated by a dotted line, which is preferably flexible and heatable. However, this conduit 11 may also have a dedicated cooling unit 12.

An inlet 13 into the second mixing kneader 10 should also be heatable, which facilitates the transfer of the pasty residue into the second mixing kneader 10.

In the second mixing kneader 10, the residues are cooled and solidified. Any vapors (for example when water is optionally added for evaporative cooling) are removed via a further vapor dome 14. This vapor dome 14, as may also be the case for the vapor dome 7, should have the possibility of installing a filter.

As mentioned, water can also be introduced into the second mixing kneader. This water promotes the solidification of the residues and removes heat in the evaporative cooling. In addition, as the case may be, it also helps to strip out an oil.

At an outlet 15 of the second mixing kneader 10, free-flowing solids are obtained. However, a large amount of powder is also present in the solidified residue, and so it is advisable to connect at least a sluice vessel 16 to the outlet 15.

An example of a method procedure is as follows:

In the first mixing kneader, degassing of kerosene and/or separation from the solids is effected under reduced pressure. The temperature of the residues is 50-195° C. It has been found here that an increase in the throughput leads to a significant improvement in the method. The initial rate was 20 kg/h. If the throughput was then increased to 40 kg/h, the consistency of the residue to be treated remained homogeneous, and the degassing was significantly improved. The state of matter at the end of the first mixing kneader can be described as pasty.

The transfer of the residue from the first mixing kneader into the second mixing kneader is effected through the heated flexible conduit 11. It is heated to about 210° C.

Depending on the feed rate, the second mixing kneader is filled with the pasty material to a maximum of about 60% of the fill level. The residue is optionally treated here with addition of water, which removes heat through evaporative cooling. At the end of the second mixing kneader, upstream of the outlet 15, the residues are in the form of free-flowing solids.

A further illustrative method procedure is as follows:

The mixture of solvent and solids mentioned (in some cases a little residual oil is still also present) enters a mixing kneader (with counterhooks) in the first process stage, where the solvent is evaporated. In the second step of the continuous process, the solids—at most with addition of water for evaporative cooling—are cooled, solidified and granulated in a mixing kneader with counterhooks. In a small amount, solvent, residual oil or water (if added) is likewise evaporated and/or stripped in the second process step.

The separation of the process into two stages is necessary since the process parameters needed (the temperatures in particular) for evaporation of the solvent and/or for granulation of the solids are too far apart for one process stage to suffice. Therefore, conventional one-stage drying processes are not an option.

On the other hand, as already mentioned, protection is likewise requested for a one-stage method. The solidification is dispensed with here, and a melt is discharged after the evaporation stage.

The invention claimed is:

1. A method of processing, recovering and/or reutilizing residues, wherein the residues are introduced into a first reactor (5), and wherein downstream of the first reactor (5) a product of the first reactor (5) is transferred into a second reactor (10) and solidified further therein by cooling, and wherein the second reactor (10) is a mixing kneader, and wherein the residues are derived from an oil refinery process and comprise a base substance with hydrocarbons and an oil.

2. The method as claimed in claim 1, wherein the residues, before being introduced into the first reactor (5), undergo a pretreatment.

3. The method as claimed in claim 1, wherein the introduction into the first reactor (5) is by means of a progressive cavity screw pump (4).

4. The method as claimed in claim 1, wherein an inlet (6) into the first reactor (5) is cooled.

5. The method as claimed in claim 1, wherein a fill level in the second reactor (10) is regulated by an adjustable weir.

6. The method as claimed in claim 1, wherein the treatment of the residues in the first reactor (5) is effected under reduced or else atmospheric pressure.

7. The method as claimed in claim 1, wherein the residues treated in the first reactor (5) are cooled on transfer into the second reactor (10) or within the second reactor.

8. The method as claimed in claim 1, wherein the residues from the first reactor (5) are heated on entry into the second reactor (10), and then solidified therein by cooling in the second reactor (10).

9. The method as claimed in claim 1, wherein the residues are treated in the second reactor (10) under reduced or else atmospheric pressure.

10. The method as claimed in claim 1, wherein at least one sluice vessel (16) is connected downstream of the second reactor (10) to receive a free-flowing granular material from the second reactor (10).

11. The method of claim 1, wherein the residues further comprise metallic residue.

12. The method of claim 1, wherein the residues are fed to the first reactor (5) as a liquid, exit the first reactor (5) as a paste, and exit the second reactor (10) as a solid.

13. The method of claim 1, wherein the residues are selected from the group consisting of residues of atmospheric distillation, distillation under reduced pressure, production of heating oil and fuels, alkylation with sulfuric acid, polymerization of a mixture of propene and butane with phosphoric acid, high-temperature isomerization, production of lubricant oils, rectification, pipe still distillation, evaporative distillation, coking, catalytic cracking, reforming, refinery hydrogenation, hydrodesulfurization of crude oil, oil bleaching by hydration, deasphaltation with solvent, indirect desulfurization of distillation residues and combinations thereof.

14. The method as claimed in claim 1, wherein the product of the first reactor (5) is additionally solidified by evaporative cooling.

15. The method as claimed in claim 1, wherein the first reactor (5) is a mixing kneader.

16. The method as claimed in claim 1, wherein the second reactor (10) is a mixing kneader having counterhooks.

17. A method of processing, recovering and/or reutilizing residues, wherein the residues are introduced into a first reactor (5), and wherein downstream of the first reactor (5) a product of the first reactor (5) is transferred into a second reactor (10) and solidified further therein by cooling, and wherein the second reactor (10) is a mixing kneader, wherein the residues contain different levels of solvent and residual oil.

* * * * *